United States Patent [19]

Kurosawa et al.

[11] Patent Number: 4,916,459

[45] Date of Patent: Apr. 10, 1990

[54] PARABOLIC ANTENNA DISH

[75] Inventors: Hiroshi Kurosawa, Tochigi; Izumi Ochiai, Tochigi; Yoshio Asahino, Tochigi; Yoichi Wakabayashi, Sano, all of Japan

[73] Assignee: Hitachi, Ltd., Tokyo, Japan

[21] Appl. No.: 26,065

[22] Filed: Mar. 16, 1987

[30] Foreign Application Priority Data

| | | | |
|---|---|---|---|
| Mar. 19, 1986 | [JP] | Japan | 61-59123 |
| Aug. 13, 1986 | [JP] | Japan | 61-188417 |
| Sep. 8, 1986 | [JP] | Japan | 61-209485 |

[51] Int. Cl.[4] ..... H01Q 15/14

[52] U.S. Cl. ..... 343/840; 343/912

[58] Field of Search ..... 343/840, 912, 915, 916, 343/897, 880–881

[56] References Cited

U.S. PATENT DOCUMENTS

| | | | |
|---|---|---|---|
| 2,181,181 | 11/1939 | Gerhard | 343/897 |
| 2,325,765 | 8/1943 | Gartenmeister | 343/915 |
| 2,423,648 | 7/1947 | Hansell | 343/840 |
| 2,858,535 | 10/1958 | Crandell et al. | 343/756 |
| 2,960,950 | 11/1960 | Hart | 113/51 |
| 3,514,781 | 5/1970 | Ferris et al. | 343/912 |
| 3,969,731 | 7/1976 | Jenkins et al. | 343/897 |
| 4,405,928 | 9/1983 | Elsbernd | 343/912 |
| 4,455,557 | 6/1984 | Thomas | 343/912 |
| 4,568,945 | 2/1986 | Winegard et al. | 343/916 |
| 4,656,486 | 4/1987 | Turner | 343/915 |

FOREIGN PATENT DOCUMENTS

| | | | |
|---|---|---|---|
| 736508 | 6/1943 | Fed. Rep. of Germany . | |
| 233905 | 11/1985 | Japan | 343/881 |
| 810249 | 3/1959 | United Kingdom . | |

OTHER PUBLICATIONS

Patent Abstracts of Japan, JP-59-174002A, 59-1740-03A, Sec. E, vol. 9 (1985), No. 31 (E-295).

Patents Abstracts of Japan, JP-59-70004A; Sec. E, vol. 8, (1984), No. 176 (E-260).

*Primary Examiner*—Rolf Hille

*Assistant Examiner*—Michael C. Wimer

*Attorney, Agent, or Firm*—Antonelli, Terry & Wands

[57] ABSTRACT

A parabolic antenna dish has a circumferential reinforcement flange portion defined by a ridge line which is devoid of air holes and a mesh plate portion integrally connected to the inner periphery of the reinforcement flange portion, the mesh plate portion having as many air holes as possible formed in a region which is not smaller than 80% in terms of the radius of the radiowave reflecting surface.

1 Claim, 9 Drawing Sheets

PARABOLIC ANTENNA DISH

BACKGROUND OF THE INVENTION

1. Field of the Invention

This invention relates to a parabolic antenna dish, and more particularly to a parabolic antenna dish having air holes suitable for reducing wind pressure applied to the parabolic surface and reducing the weight of the antenna.

2. Description of the Prior Art

A type of parabolic antenna dish with a radio wave reflecting surface having air holes in the form of a lattice has been known in which a metal plate with punched holes or an expanded metal sheet is used to form the antenna dish's radio wave reflecting surface, with the outer peripheral flange portion thereof being integrally formed of the same member, and in which the antenna surface member is fixed at the flange portion to a separate outer peripheral reinforcement member by means of welding, screws or the like. Another known example of this type of parabolic antenna dish is formed in a manner such that a mesh metal plate having or intended to have a curved surface as a radio wave reflecting surface is attached to an outer peripheral reinforcement member and to radial ribs facing the reverse surface of the radio reflecting surface.

Japanese Patent Laid-Open No. 70740/1978 discloses a parabolic antenna dish in which rows of air holes are disclosed to form coaxial circles, and the area of the air holes relative to the total area of the dish is comparatively small.

Another type of dish for parabolic antennas which has air holes formed by a metal net has been known as a means that is effective for reducing the air pressure. An example of parabolic antennas having this type of air hole is disclosed in Japanese Patent Laid-open No. 173904/1985.

If a welded metal net is used to form the radio wave reflecting surface of this type of dish of parabolic antennas, there is a difference in level 60 in the radio wave reflecting surface, which corresponds to 60 to 90% of the diameter of longitudinal wire rods 42 and lateral wire rods 41, that is, a value obtained by subtracting the bite depth at the welded portion from the wire diameter, as shown in a partial perspective view of FIG. 29 and in a partial cross-sectional view of FIG. 30 taken along a line XXX—XXX of FIG. 29. In the case of a plain weave metal net, there is necessarily a difference in level 61 which generally corresponds to the diameter of longitudinal wire rods 62 and lateral wire rods 63 and which is formed at the peaks and valleys of these combined wire rods in the form of waves, as shown in the partial perspective view of FIG. 31 and in the partial cross-sectional view of FIG. 32 taken along the line XXXII—XXXII in FIG. 31. Such degrees of difference cause a reduction in the antenna gain, and the influence of the same becomes greater as the reception frequency is increased. It is therefore necessary to reduce the diameter of the wire rods and, hence, the difference in level in accordance with the increase in the reception frequency.

As described above, the conventional methods require the provision of separated members such as an outer peripheral reinforcement member, ribs and so forth at the outer peripheral portion of the dish, and they fail to take the consideration of the desirability of a reduction in the weight of the dish or of the need to assure the strength of the dish without attaching any other member thereto. This results in the antenna being difficult to install due to the increased weight of the dish and in the components parts being more costly because of the need for a high degree of accuracy in the manufacture of the other outer peripheral reinforcement member. Furthermore, the distance between the center of the radio wave reflector and the position of each row of air holes disposed in the surface of the reflector is within a range of 30 to 80% of the radius thereof, and the reduction ratio of wind pressure is at most about 32% when calculated on the basis of the method of calculating wind pressure applied to buildings. This effect is not sufficient, and the design with respect to air holes has been heretofore made without any regard for a reduction in the weight of the antenna.

SUMMARY OF THE INVENTION

It is therefore an object of the present invention to provide a parabolic antenna dish capable of easily being installed, in which the strength of the dish is maintained by an outer peripheral flange reinforcement portion integrally formed with the dish, and in which the wind pressure to which the dish is subjected is reduced by forming air holes in the dish, as well as thereby achieving a reduction in the weight thereof.

It is another object of the present invention to provide a parabolic antenna dish which is such that the gain of the antenna is maintained at a sufficient level.

To this end, the present invention provides a parabolic antenna dish having at its outer periphery a flange reinforcement portion with no air holes, air holes being formed over the whole of the radio wave reflecting surface right up to the peripheral area thereof near the ridge at which the dish is bent to form its flange reinforcement portion.

According to the present invention, the weight of the antenna dish can be remarkably reduced by the effect of the provision of a multiplicity of air holes. In addition, an outer peripheral reinforcement flange portion without air holes, which is formed integrally with the dish, is utilized as a member for mounting the dish, thus eliminating the necessity for provision of any other outer peripheral reinforcement member on the dish. The provision of air holes also contributes to a reduction in the wind pressure or force, thus enabling the weights of mounting and installation members to be reduced. In consequence, the installation of the parabolic antenna is facilitated, and it becomes possible to install the parabolic antenna even on weak structures such as the roof of a house, a handrail of a porch, window frame, and so forth.

DETAILED DESCRIPTION OF THE PREFERRED EMBODIMENTS

The principle of the present invention will be described below.

A parabolic antenna dish with air holes having reinforcement portions and a reflector in the form of a lattice is formed in such a manner that outer peripheral reinforcement portions having no air holes are formed by a flange of the parabolic antenna dish and by the outer peripheral area of a radio wave reflector which is inscribed in the flange, and inside these reinforcement portions a multiplicity of air holes are bored by punching press or laser cutting to form the reflector in an integral manner.

Thick crosspiece portions integrally connected to the outer peripheral flange reinforcement portions are constituted by part of crosspiece portions of the inner surface which are encircled by these outer peripheral reinforcement portions and which are left after the boring of the rectangular air holes. By the effect of these crosspiece portions, the strength of the surface of the parabolic antenna can be increased without being supported by any separate reinforcement frames.

The other parts of the crosspiece portions which are situated within the sections separated by the thick crosspiece portions intersecting each other are so formed as to have a smaller width, thereby increasing the proportion of the area of the air holes relative to the entire area of the surface of the parabolic antenna dish without reducing the strength thereof. This arrangement eliminates the need for a separate reinforce member which would have to be attached to the flange of the dish, and reduces the total weight which has to be supported when the parabolic antenna is installed due to the formation of a multiplicity of air holes in the inner portion of the radio wave reflector, thus facilitating installation.

Moreover, the weight of the mounting members can be reduced, since the flowing air resistance of the dish is reduced by the effect of the provision of the air holes.

In the case of a dish formed by using a metal net, longitudinal and lateral wire rods are combined to intersect each other, with the portions of intersection thereof being flattened so as to be thinner than the diameter or the thickness of the wire rods. The thickness of these flattened portions is determined to be such that the difference in level at each mesh is less than one sixtieth of the wave length of a radio wave to be received on the basis of the curvature of the surface of the reflector formed on the parabolic antenna dish. A high level of antenna gain is thereby assured in a range of particularly high frequencies. Round wire rods or square wire rods having a larger diameter or thickness can be used by increasing the depth of the depression or cut at the flattened portions, thereby preventing any reduction in the stiffness of the metal net.

On the basis of this principle, preferred embodiments of the present invention will now be described with respect to the construction, operation and effects thereof with reference to FIGS. 1 to 28.

Figure 1:
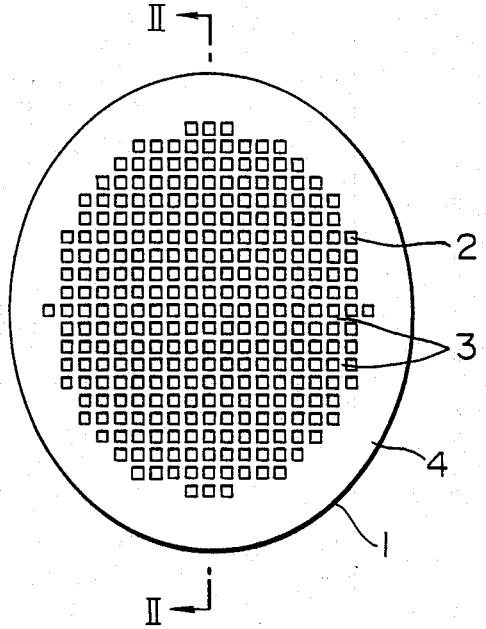
FIG. 1 is a front view of a blank in the form of an apertured metal plate provided to form a parabolic antenna in accordance with the present invention.
Figure 2:
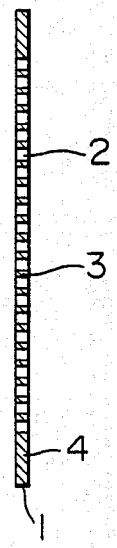
FIG. 2 is a cross-sectional view taken along a line II—II of FIG. 1.
Figure 3:
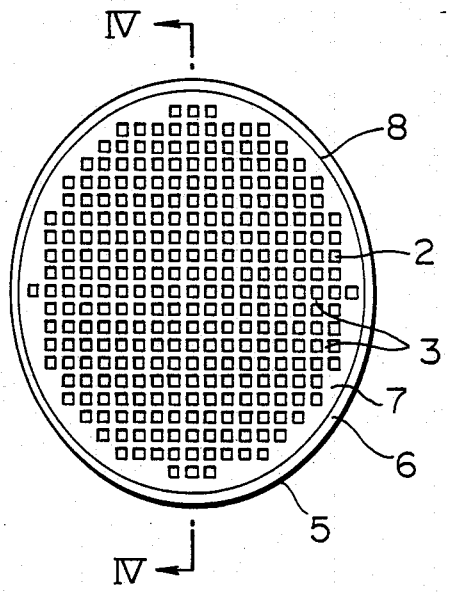
FIG. 3 is a front view f a dish which is formed from the metal blank shown in FIG. 1 and which represents an embodiment of the present invention.
Figure 4:
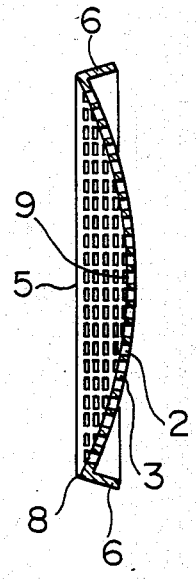
FIG. 4 is a cross-sectional view taken along a line IV—IV of FIG. 3.

FIG. 1 is a front view of a blank in the form of an apertured metal plate applied to an embodiment of the present invention, and FIG. 2 is a cross-sectional view taken along a line II—II of FIG. 1. In these drawings, reference numerals 2, 3 and 4 respectively denote air holes formed by boring a flat metal plate 1, crosspieces formed between the air holes 2, and an outer peripheral reinforcement flat plate portion. FIG. 3 is a front view of a parabolic antenna dish formed by being pressed from the blank plate shown in FIG. 1, and FIG. 4 is a cross-sectional view taken along a line IV—IV of FIG. 3. As shown in FIGS. 3 and 4, a flange reinforcement portion 7 is formed at the outer periphery of a dish 5, and a multiplicity of air holes 2 are formed in a radio wave reflector 9 over as much as possible of the entire area thereof to cover more than 80% of the radius of the reflector 9, while no air holes 2 are formed in an outer peripheral flange flank portion 6 or on the side of the reflector 9 in the vicinity of the ridge line of a flange bend ridge 8. It is thereby possible to reduce the weight of the parabolic antenna dish 5, as well as the wind pressure to which it is subjected. The dish 5 is connected to a mounting member 16 such as that shown in FIG. 11 through the flange flank portion 6, so that the outer peripheral flange reinforcement portion 7 acts as a strengthening member to strengthen the dish against wind pressure. Therefore, the thickness of the crosspieces 3 can be reduced to an extent which avoids deformation of the dish 5, while the strength of the central area of the radio wave reflector 9 is reduced by the provision of the multiplicity of air holes 2. As described above, there is no need for any separate outer peripheral reinforcement member which might be attached to the dish, and it is not necessary to apply radial ribs, since the outer peripheral flange reinforcement portion 7 has no holes and therefore provides the necessary strength. The apertured plate having the multiplicity of air holes 2 and a part of the flange reinforcement portion 7 inside the ridge thereof are formed with the same curvature to provide a uniformly curved surface, so that accuracy of the surface of the reflector for reflecting a received radio wave can be improved such as to enable the converter to collect a reflected radio wave at an improved level of quality, thereby improving the receiving performance of the parabolic antenna. Correspondingly, the outer diameter of the parabolic antenna dish can be reduced, and the weight of the dish or the mounting members can be further reduced.

The air holes 2 are arranged to be aligned in the vertical and horizontal directions or the longitudinal and lateral directions, and the crosspieces 3 between the air holes 2 are formed linearly and continuously, so that wind pressure or external force applied to the radio wave reflector 9 acts as a tensile force or compressive force. Accordingly, any external force applied to the crosspieces 3 is transmitted to the outer peripheral flange reinforcement portion 7, and the part of the external force absorbed by the crosspieces 3 is small enough to avoid deformation of the crosspieces 3, thus assuring that a high degree of accuracy of the radio wave reflector 9 is maintained. When the dish is formed, the crosspieces 3 have the capability to uniformly disperse tensile forces which act on the dish. To reduce the flowing air resistance, it is necessary to reduce the width of the crosspieces 3 as much as possible, and the proportion of the area of the crosspieces 3 relative to that of the air holes 2 may be minimized when the air holes 2 have a square or rectangular shape. A square shape is more preferable in terms of reduction of both the flowing air resistance and the weight.

The size of each air hole 2 is determined to be small enough to avoid resonance with a wave to be received on the basis of the manner of the reflection of the received radio wave. If the wave length of a wave to be received is λ, the maximum width D of each air hole 2 is represented by an equation:

$$D \leqq \frac{\lambda}{\pi} \text{ (}\pi\text{: the circular constant).}$$

It is generally said that the size of air holes suitable for receiving 12 GHz radio waves of satellite broadcasting is smaller than ¼ inch. In the case of satellite broadcasting in Japan, the maximum width D of the air holes 2 of a receiving antenna is smaller than about 7.9 mm. It is preferable to increase the size of the air holes 2 with a view to reducing the flowing air resistance and the weight of the antenna. Similarly, it is advantageous to provide plastic parabolic antenna dishes with air holes in accordance with the present invention.

Figure 5:
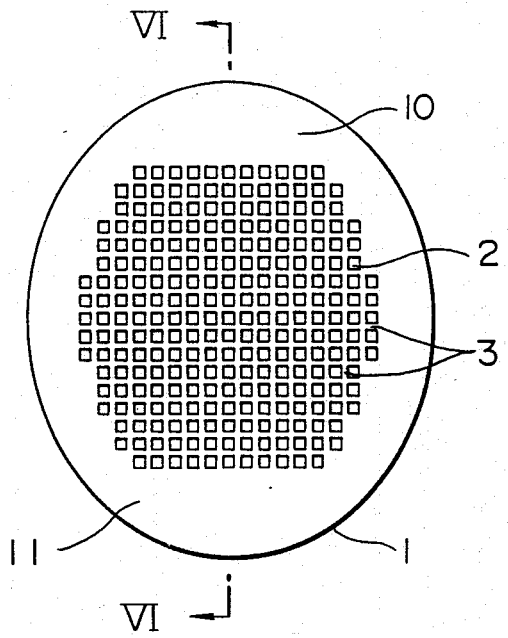
FIG. 5 is a front view of a blank in the form of a metal plate having a reinforcement flat plate portion and provided to form a parabolic antenna in accordance with the present invention.
Figure 6:
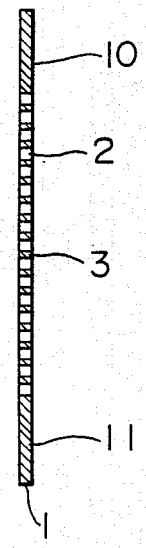
FIG. 6 is a cross-sectional view taken along a line VI—VI of FIG. 5.
Figure 7:
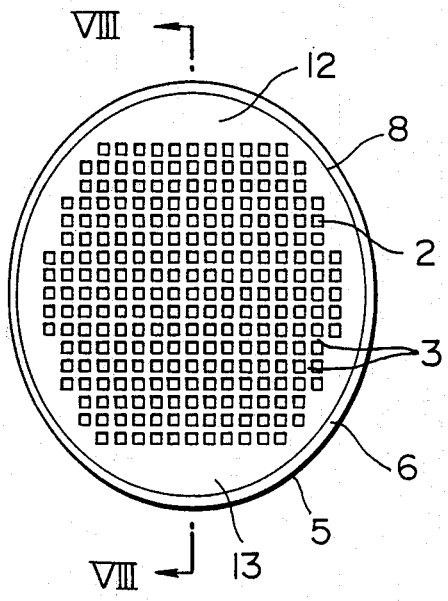
FIG. 7 is a front view of a dish which is formed from the metal blank shown in FIG. 5 and which represents another embodiment of the present invention.
Figure 8:
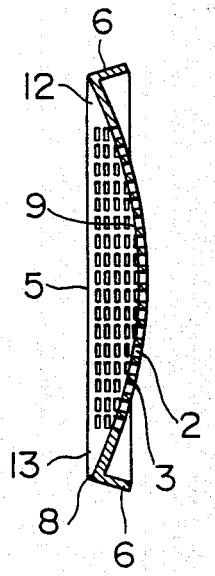
FIG. 8 is a cross-sectional view taken along a line VIII—VIII of FIG. 8.

FIG. 5 is a front view of a blank plate which is formed by providing the blank plate 1 with a reinforcement portion consisting of a flat plate, and FIG. 6 is a cross-sectional view taken along a line VI—VI of FIG. 5. In these drawings, the same reference numerals as those used in FIG. 1 indicate the same or equivalent portions, with a reference numeral 10 and 11 indicating upper and lower reinforcement flat plate portions. Each reinforcement flat plate portion is preliminarily formed to have a large area and is then press-formed to provide upper and lower attachment reinforcement portions 12 and 13, as shown in FIGS. 7 and 8. FIG. 7 shows a front view of a parabolic antenna dish which represents another embodiment of the present invention and which is formed by pressing from the blank plate shown in FIG. 5, and FIG. 8 shows a cross-sectional view taken along a line VIII—VIII of FIG. 7. As shown in FIGS. 7 and 8, each of the upper attachment reinforcement portion 12 and the lower attachment reinforcement portion 13 has a width smaller than 20% of the radius of the radio wave reflector.

Figure 9:
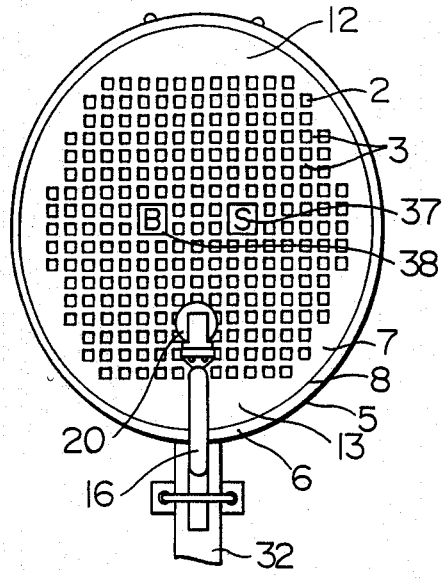
FIG. 9 is a front view of the mounted state of the dish shown in FIG. 7.
Figure 10:
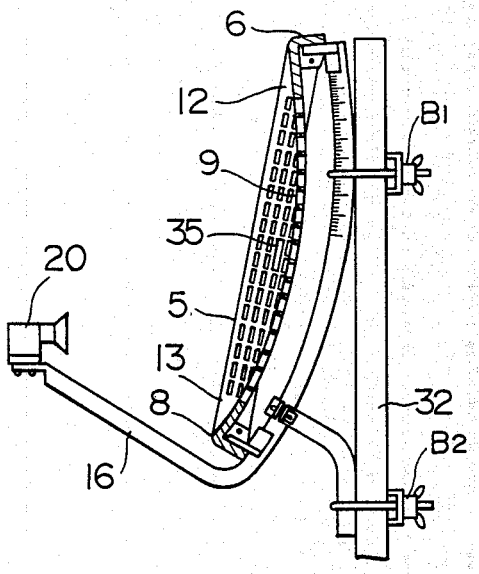
FIG. 10 is a side view of the mounted state of the dish shown in FIG. 9, partly in section across the surface of the dish.

FIGS. 9 and 10 show the state of the antenna dish shown in FIGS. 7 and 8, in which the antenna dish is attached to mounting members. FIG. 9 is a front view of the state of the antenna dish 5 when the antenna dish 5 is mounted on a support mast 32 of a building, and FIG. 10 is a side view of the same. The antenna dish 5 and a converter 20 are attached to the mounting member 16 shown in FIG. 11, which is fixed to the support mast 32 by means of bolts $B_1$ and $B_2$.

Figure 11:
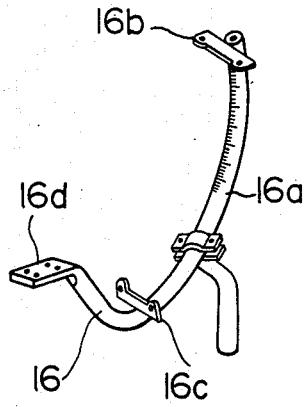
FIG. 11 is a perspective view of a metal attachment member.

As shown in FIG. 11, the mounting member 16 is constituted by a circular-arc arm 16*a*, attachment portions 16*b* and 16*c* welded to the circular-arc arm 16*a*, and a converter attachment portion 16*d*. The flange flank portion 6 of the dish 5 shown in FIG. 9 is fixed by bolts to the upper attachment portion 16*b* and the lower attachment portion 16*c*.

Figure 12:
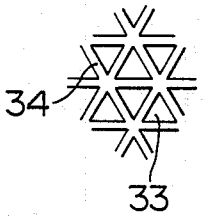
FIG. 12 is a segmentary view of a net having triangular air holes.
Figure 13:
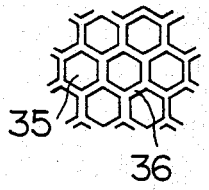
FIG. 13 is a segmentary view of a net having hexagonal holes.

FIGS. 12 and 13 respectively show examples of the form of the air holes. In the example shown in FIG. 12, in order to improve the strength of the dish 5, the air holes are provided in the form of triangles, and crosspieces 34 intersect with each other at angles of 60°, thereby increase the strength of the apertured plate portion.

In the example shown in FIG. 13, hexagonal air holes 35 are bored so as to reduce the irregularity of the outer peripheral ends in the air holes at the outer peripheral portion of the antenna dish. In this case, crosspieces 36 do not intersect each other but meet at angles of 120° to balance the force applied thereto, thereby enabling the provision of air holes each having a large size in the surface of the antenna dish while maintaining the strength thereof.

Figure 14:
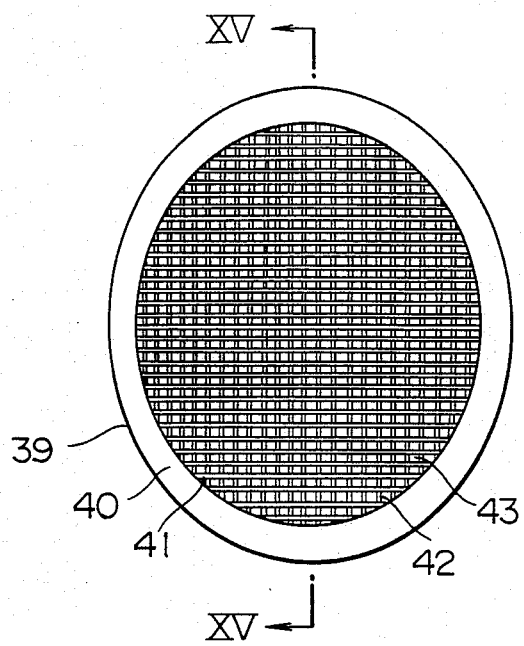
FIG. 14 is a front view of a blank plate constituted by a metal plate in the form of a ring and by metal wire rods.
Figure 15:
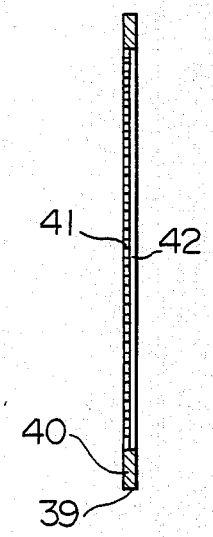
FIG. 15 is a cross-sectional view taken along a line XV—XV of FIG. 14.
Figure 16:
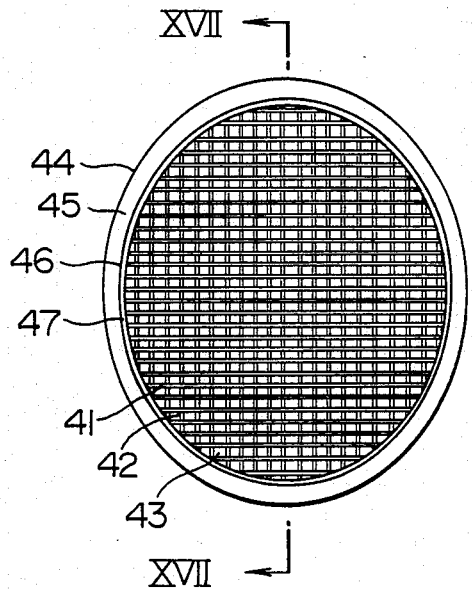
FIG. 16 is a front view of a formed dish.
Figure 17:
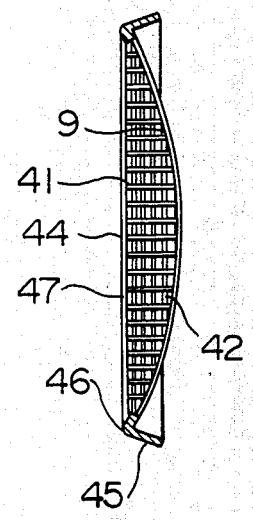
FIG. 17 is a cross-sectional view taken along a line XVII—XVII of FIG. 8.

Also, according to the present invention, the air holes may be formed by welding lateral and longitudinal wire rods to each other to form the parabolic antenna dish. FIG. 14 shows a blank plate 39 with air holes 43 which is formed by welding lateral wire rods 41 and longitudinal wire rods 42 to a flat plate 40 in the form of a ring, and FIG. 15 is the cross-sectional view taken along the line XV—XV in FIG. 14. FIG. 16 shows a parabolic antenna dish 44 which is formed by pressing from the blank shown in FIG. 14, and FIG. 17 is the cross-sectional view taken along the line XVII—XVII in FIG. 16. In these drawings, a reference numeral 47 denotes a flange reinforcement portion which is constituted by a flange 45 with a ridge 46 in the form of an L-shaped angle. Thus, the parabolic antenna dish 44 has at its outer periphery the flange reinforcement portion 47 in the form of a ring improved in strength.

As shown in FIGS. 16 and 17, the radio wave reflector of the antenna dish 44 is made of a net which may be constituted by round wire rods made of metal provided as the lateral wire rods 41 and the longitudinal wire rods 42, thereby further reducing the flowing air resistance of the parabolic antenna dish.

Figure 18:
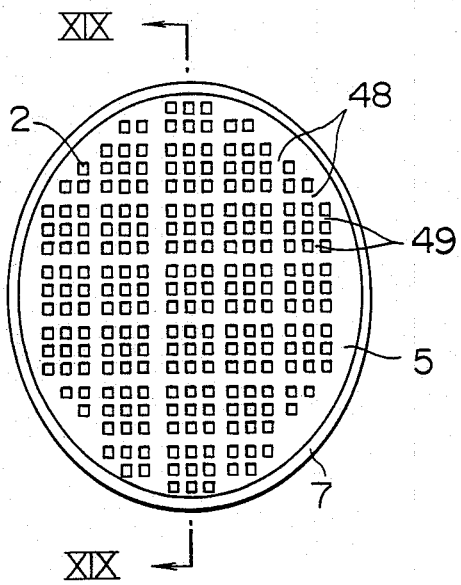
FIGS. 18 and 20 are front views of a metal parabolic antenna dish which represent further embodiments of the present invention.
Figure 19:
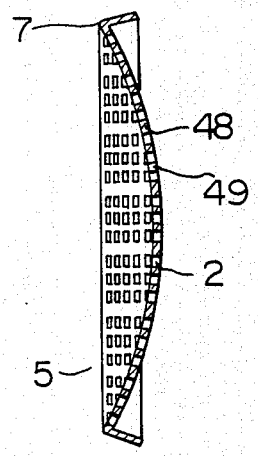
FIG. 19 is a cross-sectional view taken along a line XIX—XIX of FIG. 18.

FIG. 18 is the front view of a parabolic antenna dish of metal which represents still another embodiment of the present invention, and FIG. 19 shows the longitudinal cross-sectional view of the antenna dish shown in FIG. 18 (taken along the line XIX—XIX). As shown in FIGS. 18 and 19, the antenna dish is provided with an outer peripheral flange reinforcement portion 7, a multiplicity of rectangular air holes 2 in which the length of one of the sides of each hole is limited to not more than $1/\pi$ of the wave length of the radio wave to be received, and crosspiece portions which are left after the plurality of rectangular air holes have been formed and which consist of thick crosspieces 48 in the form of a grid formed in the inner surface of the dish encircled by the outer peripheral flange reinforcement portion such as to be integrally connected to the same, and thin crosspieces 49 in the form of a grid formed in each section defined by the intersection of the thick crosspieces.

In this arrangement, the crosspiece portions which are left after the plurality of rectangular air holes 2 have been formed include the thick crosspieces 48 in the form of a grid which are formed in the inner surface of the antenna dish encircled by the outer peripheral flange reinforcement portion 7 such as to be integrally connected to the same. By the effects of these reinforcement crosspiece portions, the strength of the surface of the parabolic antenna dish can be increased without providing any separate reinforcement frames.

The crosspiece portions also include the thin crosspieces 49 in the form of a grid formed in each section defined by the intersection of the thick cross-pieces 48, thereby increasing the proportion of the area of the rectangular air holes 2 relative to the total area of the surface of the parabolic antenna dish without reducing the strength thereof.

As an example of a parabolic antenna dish in accordance with the present invention, an offset type parabolic antenna dish having an outside diameter of 48 cm has been provided by forming 2,871 air holes in the form of 6×6 mm squares together with crosspieces having a width of 2 mm. In this example, the width of the flange flank portion is 16 mm; the minimum distance between the ridge of the flange and the outer edge of the outermost air hole is 10 mm, and a reduction of 45% in the weight of the antenna dish itself has been realized. The remaining projectable area including the flange flank portion is 51% of that of an antenna dish having no apertures, and the reduction of the flowing air resistance is about 42% when calculated in accordance with the method of calculating the wind pressure resistance of buildings. Accordingly, the weight of this example has been further reduced compared with conventional antenna dishes, thereby improving the installation of the antenna. Since the dish of this example has air holes which lack in the conventional antenna dishes, it is possible to reduce wind pressure to which the parabolic surface is subjected by a typhoon or the like so that the parabolic surface can be prevented from being rotated from its position or broken by the wind pressure even when the antenna is installed on a roof.

When air holes in the form of, e.g., 6×6 mm squares are bored as much as possible to cover more than 80% of the radius of the radio wave reflecting surface in the manner in accordance with the present invention, the proportion of bored areas, the proportion of a remaining area and the index of received wind force with respect to each range of boring are as shown in the following table 1.

TABLE 1

| Boring range | Proportion of bored area | Proportion of remaining area | Index of received wind force |
|---|---|---|---|
| 80% | 47.0% | 53.0% | 60.6% |
| 90% | 59.5% | 40.5% | 46.3% |
| 95% | 66.3% | 33.7% | 38.5% |
| (100% | 73.5% | 26.5% | 30.3%) |

Index of received wind force = Proportion of remaining area × 1.6 × 1.4

(Coefficient of wind force of a net in the form of a lattice = 1.6)

(Coefficient of wind force of a parabolic antenna = 1.4)

The proportion of bored areas in the above table 1 corresponds to the index of the reduction in the weight of the antenna dish. Since the index of received wind force represents reduced wind force which is received at the parabolic surface, the index of reduction in received wind force is obtained by subtracting the index of received wind force from 100.

To achieve an index of reduction of more than 45% in the weight and an index of reduction of more than 40% in the pressure of received wind, the range of boring is necessarily set to be more than 80%.

TABLE 2

| Sampled parabolic antenna dish | Antenna Gain (including a converter) (dB) | Air holes Number | Air holes Proportion of area (%) | Received wind pressure (Kg) |
|---|---|---|---|---|
| Example of the invention With 2 mm width thick cross-pieces, 1 mm width thin crosspieces, and air holes | 71 | 3,372 | 60.8 | 17 |
| Reference example 1 With plain curved surface, and no air holes | 71 | 0 | 0 | 55 |
| Reference example 2 | 71 | 2,871 | 51.7 | 24 |

TABLE 2-continued

| Sampled parabolic antenna dish | Antenna Gain (including a converter) (dB) | Air holes Number | Air holes Proportion of area (%) | Received wind pressure (Kg) |
|---|---|---|---|---|
| With 2 mm width longitudinal and lateral crosspieces, and air holes | | | | |

The above Table 2 shows the results of the comparison between an offset type parabolic antenna dish which has multiplicity of rectangular air holes in the form of 6×6 mm squares, thick crosspieces having a width of 2 mm, thin crosspieces having a thickness of 1 mm, such as described above with respect to the embodiment, a non-bored reinforcement portion having a width of 10 mm formed inside the outer peripheral flange bend ridge such as to encircle the air holes and the crosspieces and a plain curved surface without any air holes and in which the minor axis diameter of the radio wave reflecting surface is 480 mm (Reference Example 1), and an another antenna dish having air holes in the form of 6×6 mm squares and longitudinal and lateral crosspieces having the same width of 2 mm (Reference Example 2). These antenna dishes are compared with respect to the receiving level at the antenna, the number of air holes, the area of air holes, and the pressure of received wind. The parabolic antenna dish in accordance with the present invention displays a larger number of air holes and a greater proportion of the area of air holes compared with Reference Example 2; the increase in the number of air holes is 501; and the increase in the proportion is 9.1%, resulting in a reduction of 7 kg (29%) in the pressure of received wind at the wind velocity of 40 m/sec. Reference Example 2 represents a parabolic antenna dish having air holes such as shown in FIGS. 18 and 19. On the other hand, the antenna gain at 12 GHz which is the frequency pf the satellite broadcasting is the same as that of Reference Example 1, and the receiving performance is remarkably good.

Figure 20:
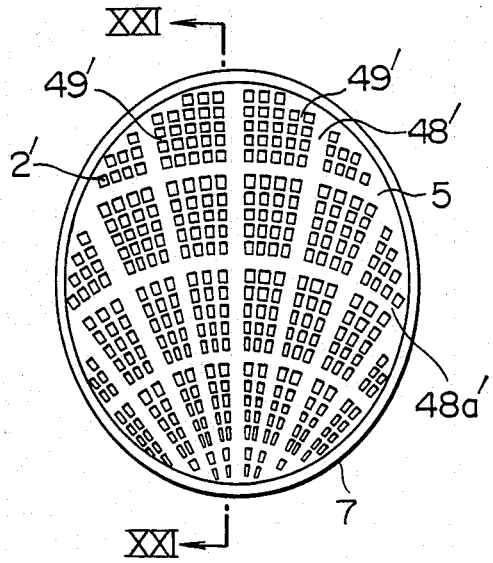
Figure 21:
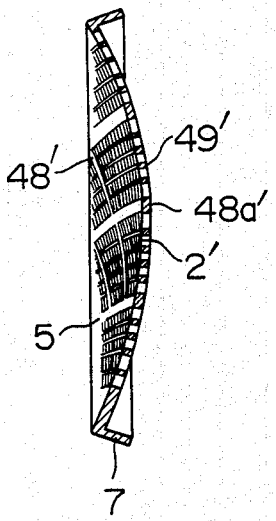
FIG. 21 is a cross-sectional view taken along a line XXI—XXI of FIG. 20.

FIGS. 20 and 21 show a further embodiment of the present invention exhibiting the same effect as that of the embodiment shown in FIGS. 18 and 19. The present invention will be described below with reference to FIGS. 20 to 22.

Figure 22:
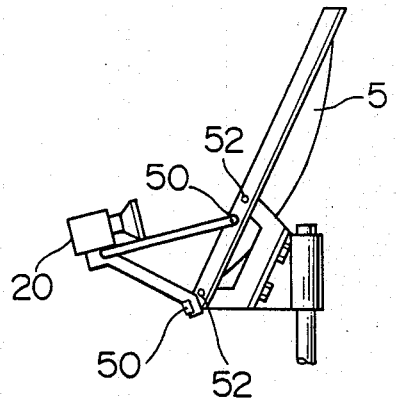
FIG. 22 is a state of the dish shown in FIG. 20 mounted on a supporting mast.

FIG. 20 is the front view of a parabolic antenna dish made of metal which represents one embodiment of the present invention, and FIG. 21 is the cross-sectional view taken along the line XXI—XXI in FIG. 20. FIG. 22 is the side view of the mounted state of the parabolic antenna dish 5 in accordance with the present invention in which a converter 20 is attached to the parabolic antenna dish 5 and in which the parabolic antenna dish is supported by a support mast at three point on lower portions of the outer peripheral reinforcement portion.

As shown in FIGS. 20 to 21, the parabolic antenna dish in accordance with the present invention is provided with an outer peripheral flange reinforcement portion 7 and a multiplicity of air holes 2'. The length of one of the sides of each hole 2' is limited to equal or smaller than $1/\pi$ of the wave length of the radio wave to be received. As shown in FIG. 22, the parabolic antenna dish is mounted and fixed to the mast at four support points 52 (other side of these points is not shown). The antenna dish has thick crosspieces 48' which radially extend from points on the outer flange reinforcement portion within lower support points to those situated outside these support points, circular-arc or linear thick crosspieces 48a' which laterally extend and intersect with the radial thick crosspieces and which are disposed at suitable intervals, and thin crosspieces 49' which are disposed in each sector defined by the intersection of the radial thick crosspieces 48' and the lateral which crosspeices 48a' and which form, together with the thick crosspieces, the multiplicity of air holes 2'. The converter 20 is attached to the lower half portion of the parabolic antenna dish at support points 50.

In the arrangement of this embodiment, the thick crosspieces radially extend from the lower end of the outer flange reinforcement portion to points on the same other than this support point while intersecting the thick crosspieces which laterally extend, thereby reinforcing the surface of the parabolic antenna dish to improve the same in terms of the strength against wind pressure without providing any other reinforcement frames. In this arrangement also, the thin crosspieces are disposed in the longitudinal and lateral directions in each section defined by the intersection of the thick crosspieces, thereby making it possible to bore a multiplicity of air holes without reducing the strength of the surface of the parabolic antenna dish. If, in this arrangement, the width of each of the thick and thin crosspieces is constant, the number of air holes gradually increases toward a part of the upper outer peripheral reinforcement portion which is located on the side opposite to that of the support points and toward which the radial thick crosspieces fan out, and, proportionally, the proportion of the area of the air holes are gradually increased, thus reducing the pressure of received wind acting on the parabolic antenna dish at the side opposite to that of the support points so as to reduce the bending moment which acts on the antenna dish at the side of the lower support points.

The lower half portion of the parabolic antenna dish in which the attachment support points 50 for supporting the converter 20 are positioned has a greater strength than that of the upper half portion, so that the total material cost of the antenna dish can be reduced.

The shape of each section defined by the intersection of the thick crosspieces in which the multiplicity of air holes are formed by the thin crosspieces differs in accordance with the formation of the intersecting thin crosspieces which might be linear or arched, and it also differs depending upon the position of each area on the surface of the parabolic antenna dish. Therefore, it is preferable to arrange the thin crosspieces in such a manner that the air holes display one of square, triangular, polygonal, e.g., trapezoidal, and fan-like shapes, or display a combination of these shapes in accordance with the shape of each section.

In this embodiment also, the thick crosspieces which are integrally connected to the outer peripheral flange reinforcement portion are provided, and the strength of the surface of the antenna dish can be increased by the effect of these thick crosspieces which function to reinforce the antenna dish without requiring any other reinforcement frames.

According to the present invention, an antenna dish which has a surface displaying a high degree of accuracy can be provided by forming a radio wave reflecting surface from a metal net in which difference in level is minimum at the portions at which longitudinal and lateral wire rods constituting the net intersect each other.

Figure 23:
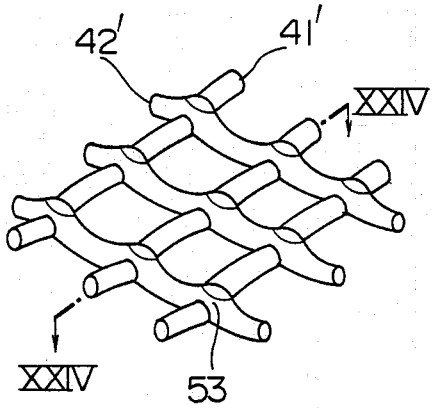
FIG. 23 is a partial perspective view of a welded metal net for forming a parabolic antenna dish which represents a further embodiment of the present invention.
Figure 24:
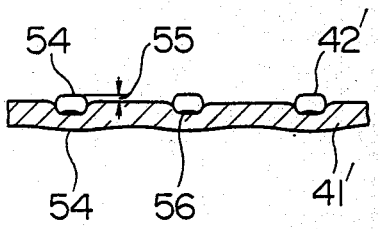
FIG. 24 is a partial cross-sectional view of the welded metal net taken along a line XXIV—XXIV of FIG. 23.

FIG. 23 is the partial perspective view of a welded metal net constituted by round wire rods which is provided to form a curved surface of a parabolic antenna dish which represents still another embodiment of the present invention, and FIG. 24 is the partial cross-sectional view taken along the line XXIV—XXIV in FIG. 23.

In FIGS. 23 and 24, reference numerals 42' and 41' denote longitudinal and lateral wire rods, and a reference numeral 53 denotes the portions at which the longitudinal and lateral wire rods intersect each other. As shown in the partial cross-sectional view of FIG. 23 taken along the line XXIV—XXIV, the longitudinal and lateral wire rods are respectively provided with flattened portions 54 having a thickness smaller than the diameter of the blank rod, and the wire rods are disposed and constructed in such a manner that these flattened portions 54 intersect each other and that, when the net is formed to be a parabolic antenna dish having a given curvature, the difference in level 55 at each mesh formed by the longitudinal and lateral wire rods is limited to not more than one sixtieth of the wave length of the radio wave to be received on the basis of the curvature of the surface of the radio wave reflecting surface of this antenna dish. The longitudinal and lateral wire rods are integrally connected to each other at the intersecting portions through welding portions 56 which are securely welded to form spot welding nuggets.

The material for forming the welded metal net may include any metal material so long as it is capable of reflecting radio waves, and square wire rods may be used in place of the round wire rods which are applied to these embodiments. To form the flattened portions of the wire rods, a method of forming flattened portions which employs apparatus for effecting spot welding or projection welding while applying pressure to welding electrodes to flatten the wire rods may preferably be utilized as well as methods of pressing by means of, e.g. rollers or grinding.

Figure 25:
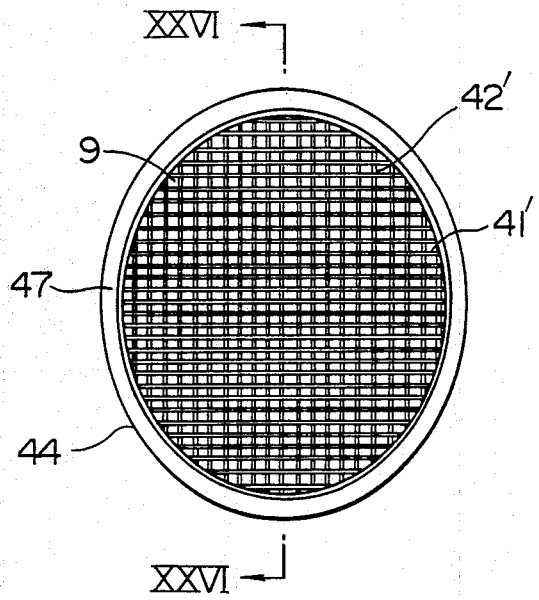
FIG. 25 is a front view of the parabolic antenna dish formed by the welded metal net shown in FIG. 23.
Figure 26:
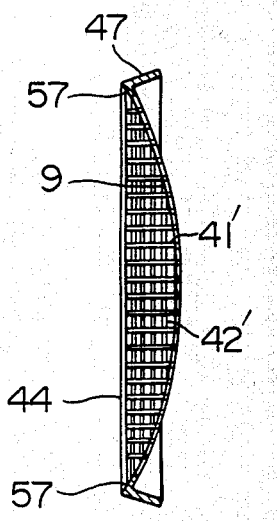
FIG. 26 is a longitudinal cross-sectional view of the parabolic antenna dish taken along a line XXVI—XXVI of FIG. 25.

FIG. 25 is the front view of an example of the parabolic antenna dish 44 which is formed by integrally connecting a welded metal net such as shown in FIG. 23 to the outer peripheral reinforcement ring which has been bent at its edge to form a flange, and FIG. 26 is the longitudinal cross-sectional view of this antenna dish. In FIGS. 25 and 26, a reference numeral 47 denotes a flange reinforcement member in the form of a ring, and a reference numeral 9 denotes a reflector of the antenna dish 44. If the area of a part of the reflecting surface of the reflector 9 located on the flange reinforcement member 47 is within a range which ensures that it is negligible in relation to the total area of the reflector, it is not necessary to limit the difference in level between the reflecting surface of the flange reinforcement member 47 and the surface of the metal net. If the proportion of the area of the reflecting surface on the flange reinforcement member 47 is considerably large, the difference in level at the connecting portion 57 is limited in such a manner that the difference in level over the entire are which covers the reflecting surface of the flange reinforcement member and the area of the metal net is set to be equal to or smaller than one sixtieth of the wave length of the radio wave to be received, on the basis of the curvature with which the reflector 9 of the antenna dish is formed.

Figure 27:
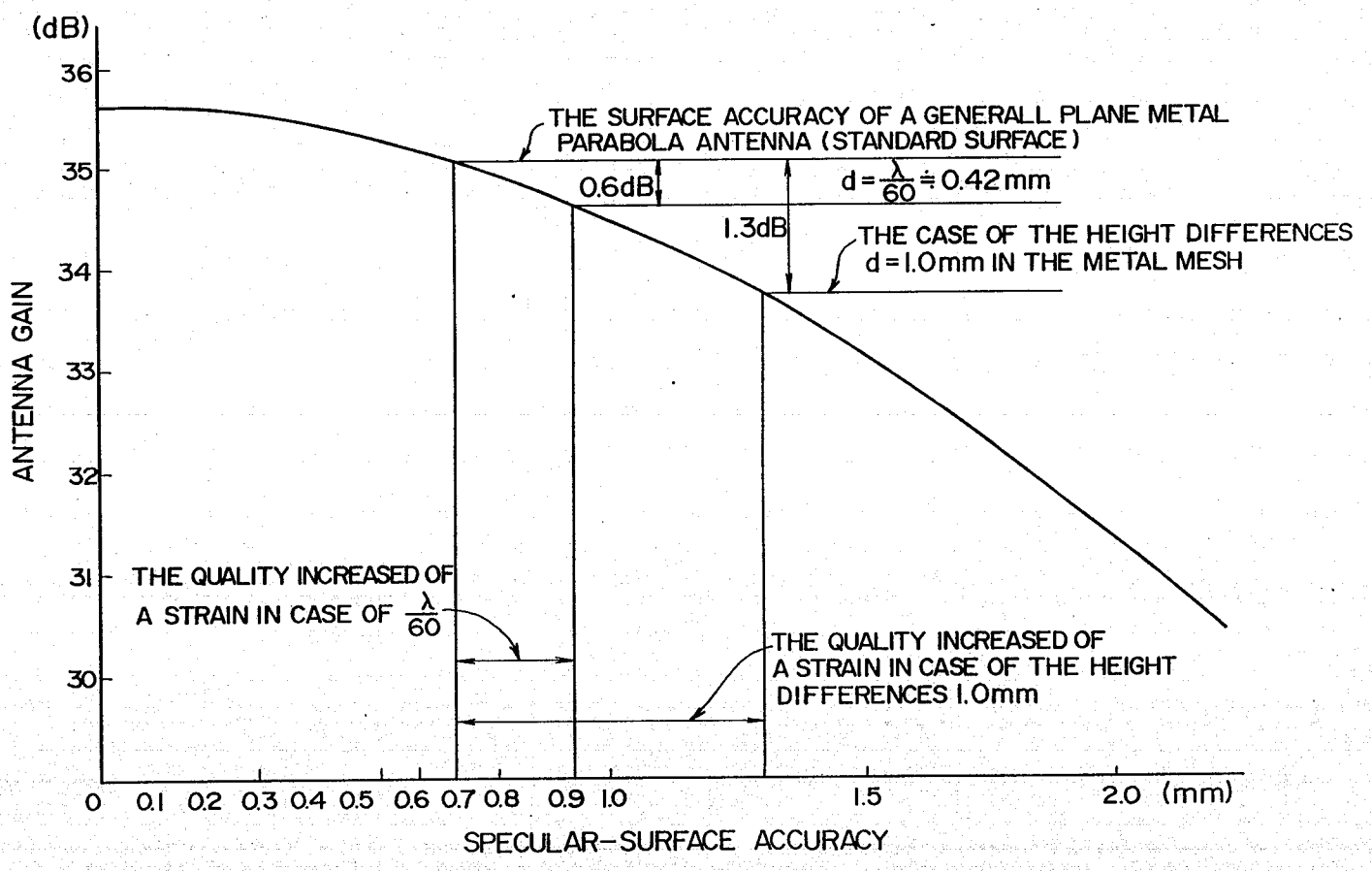
FIG. 27 is a graph of the relationship between the profile irregularity of the reflector and the antenna gain.

If a parabolic antenna dish in which the diameter of the reflector is 480 mm and which exemplifies this embodiment is manufactured from a welded metal net formed by wire rods having a diameter of 1.2 mm and from a flange reinforcement member in the form of a ring having a thickness of 1.2 mm, and if a radio wave having a frequency of 12 GHz specific to the satellite broadcasting is received by using this antenna, the relationship between the specular-surface accuracy of the reflector formed in this dish (determined by the difference in level in the surfaces of the antenna dish) and the antenna gain is as indicated in the characteristic graph of FIG. 27, in which the abscissa represents the specular-surface accuracy and the ordinate represents the antenna gain. It is possible for the parabolic antenna dish in accordance with the present invention to display a high level of antenna gain equal to or more than 34.65 dB by limiting the difference in level in the surface of the antenna dish to one sixtieth of the wave length of the radio wave to be received (at 12 GHz, $$d = \frac{\lambda}{60} \approx 0.42 \text{ mm}).$$

This value indicates a reduction in the antenna gain of only 0.4 dB or less relative to an antenna gain of 35.05 dB of an antenna dish which is formed by being pressed from a flat metal plate to have a comparatively high degree of accuracy of the reflecting surface. The antenna gain in this embodiment is thus satisfiable.

In contrast, if a parabolic antenna dish is manufactured, as an example of the conventional parabolic antenna, from a welded letal net formed by wire rods having a diameter of 1.2 mm without being provided with any special flattened portions and in which the difference in level in the reflector is 1.0 mm (reduction in the diameter caused by pressing at the crossing portions of the metal net: 17%), this parabolic antenna provides an antenna gain of 33.75 dB, thus providing a reduction in the antenna gain of 1.3 dB compared with that of the above-described antenna dish formed by pressing a flat metal plate. This rate of reduction is three times higher than that in the case of the above-described antenna dish in accordance with the present invention in which the crossing portions are preliminarily flattened. Accordingly, it is desired to flatten, as much as possible, the radio wave reflecting surface of the reflector.

When a conventional type of a welded metal net without any special flattened portions is used to obtain an antenna gain equal to that realized by the parabolic antenna dish in accordance with the present invention formed from a welded metal net having flattened portions, the daimeter of the wire rods for forming the net is necessarily not more than 0.5 mm (when the degree of depression at the crossing portions is 16%). This means that the cross-sectional area of the wire rods of the net is reduced to about one sixth, and the modulus of section thereof is reduced to about one fourteenth, resulting in a considerable reduction in the stiffness of the net.

With respect to the above-described parabolic antenna dish in which the reflector 9 which has a diameter of 480 mm is formed by using a welded metal net constituted by wire rods having a daimeter of 1.2 mm and having flattened portions, a sufficiently high degree of practical strength of the antenna dish can be realized by integrally connecting the net to the flange reinforcement portion 47 in the form of a ring without requiring any other reinforcement frames.

Figure 28:
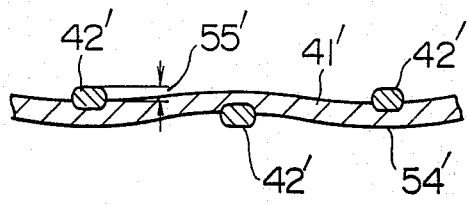
FIG. 28 is a partial cross-sectional view of plain weave metal net or forming a parabolic antenna dish which represents a further embodiment of the present invention.
Figure 29:
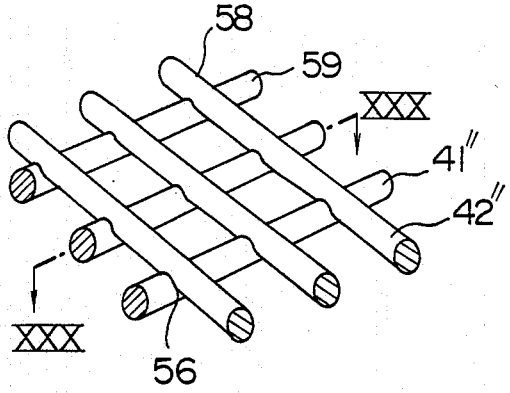
FIG. 29 PRIOR ART
FIG. 29 is a partial perspective view of a welded metal net for forming a conventional parabolic antenna dish.
Figure 30:
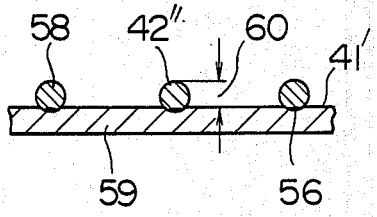
FIG. 30 PRIOR ART
FIG. 30 is a partial cross-sectional view taken along a line XXX—XXX of FIG. 29.
Figure 31:
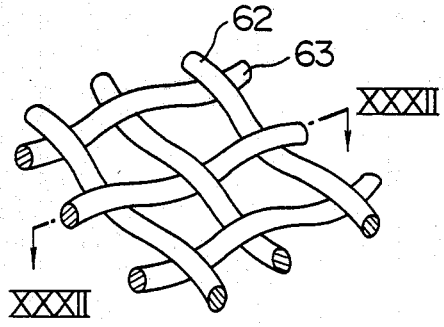
FIG. 31 PRIOR ART
FIG. 31 is a partial perspective view of a plain weave metal net for forming another conventional parabolic antenna dish.
Figure 32:
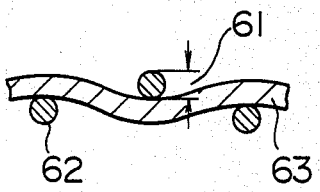
FIG. 32 PRIOR ART
FIG. 32 is a partial cross-sectional view taken along a line XXXII—XXXII of FIG. 31.

FIG. 28 is a fragmentary sectional view of a plain-woven metal mesh incorporated in a still further embodiment of the present invention. In this embodiment, the metal mesh constituting the reflector is formed of a plurality of longitudinal wire rods 42' and lateral wire rods 41' which cross each other, the crossing portions of these wire rods 42' and 41' being flattened as at 54'. In this embodiment also, the height difference 55' of the metal mesh as measured on the basis of the curvature of the reflector surface is determined to be not greater than 1/60 of the wavelength of the received radiowave. The flattened portions 54' of the wire rods 41', 42' may be formed by any desired method. For instance, the flattened portions 54' may be formed by pressing a plain-woven metal mesh between a pair of parallel plates or passing the same through nips between pairs of rolls. Thus, in this embodiment, the thickness of the flattened portions of the wire rods is determined such that the height difference in the reflector surface as measured on the basis of the curvature of the reflector surface is not greater than 1/60 of the wavelength of the received radiowave. This arrangement provides a reflector which is free from problems such as reduction in the antenna gain and reduction in the rigidity of the antenna structure.

As will be understood from the foregoing description, according to the invention, the weight of the antenna dish can be remarkably reduced by virtue of provision of a multiplicity of air holes. In addition, a circumferential reinforcement flange portion without air holes, which is formed integrally with the dish, is utilized as a member for mounting the dish, thus eliminating necessity for provision of any other circumferential reinforcement member on the dish. The provision of air holes also contributes to a reduction in the wind pressure or force, thus enabling the weights of mounting and installation members to be reduced. In consequence, the installation of the parabolic antenna is facilitated, and it becomes possible to install the parabolic antenna even on weak structures such as the roof of a house, a handrail of a porch, a window frame, and so forth.

What is claimed is:

1. A parabolic antenna dish comprising:

a ring-like outer peripheral flange portion integrally formed at an outer periphery of a reflector for receiving radio waves and a porous plate portion in which a plurality of air holes are formed, wherein said air holes in said reflector are continuously formed from the center portion of said reflector and approach a ridge line constituting a bent portion of said outer peripheral flange portion so that said air holes continuously cover a region which is greater than 80% of a radius of said reflector, said air holes are arranged in parallel rows, and aligned crosspieces are formed in spaces between said air holes resulting from perforation of said reflector, said crosspieces being of solid reflector metal and comprising first crosspieces of one thickness and second crosspieces of smaller thickness than said first crosspieces such that the spaces between said air holes are nonuniform, said porous plate portion being formed from said first crosspieces linearly arranged in longitudinal and lateral directions, and said air holes being separated by said second crosspieces and disposed in groups separated by said first crosspieces.

* * * * *